United States Patent [19]

Kawasaki et al.

[11] 4,298,823

[45] Nov. 3, 1981

[54] FLUORESCENT DISPLAY DEVICE

[75] Inventors: Kishio Kawasaki; Takao Kishino, both of Mobara, Japan

[73] Assignee: Futaba Denshi Kogyo K.K., Mobara, Japan

[21] Appl. No.: 94,985

[22] Filed: Nov. 16, 1979

[30] Foreign Application Priority Data

Nov. 28, 1978 [JP] Japan ..... 53-162666[U]

[51] Int. Cl.[3] ..... H01J 63/04

[52] U.S. Cl. ..... 313/497; 313/292

[58] Field of Search ..... 313/497, 292

[56] References Cited

U.S. PATENT DOCUMENTS 4,190,787 2/1980 Kishino et al. ..... 313/497 X

*Primary Examiner*—Palmer C. Demeo

*Assistant Examiner*—Darwin R. Hostetter

*Attorney, Agent, or Firm*—Oblon, Fisher, Spivak, McClelland & Maier

[57] ABSTRACT

A fluorescent display device is disclosed having a grid which is divided into several pieces electrically separated and disposed in close proximity and in an opposed relationship at the edges thereof. The grids are held in position within the display device by an elongated insulator which bridges the respective opposed edges of the grids and a sealing portion around the periphery of the display device.

3 Claims, 11 Drawing Figures

FLUORESCENT DISPLAY DEVICE

BACKGROUND OF THE INVENTION

1. Field of the Invention

This invention relates to a display device, and more particularly to a fluorescent display device having a plurality of control electrodes electrically separated from one after another for energizing different types of indicia.

2. Description of the Prior Arts

In a fluorescent display device formed of a substrate and a front cover which are airtightly sealed to form a vacuum envelope, control electrodes (hereinafter referred to as grids) are mounted on the substrate in such manners as shown in FIG. 1 (A) and FIG. 1 (B). In FIG. 1 (A), the grids 2 are directly bound on the substrate 3 by applying an adhesive material 1, such as, for example, crystalline powdered glass or the like, to the periphery of the grids 2 which are to be mounted on the substrate 3 in an opposed relationship to anodes (not shown) on which phosphor layers are deposited, and the subjecting the adhesive material 1 to heat at a high temperature for calcination and crystallization of the adhesive material 1. However, in the method of fixing grids by means of the adhesive material, it is difficult to determine exact locations for mounting the grids 2 with respect to the substrate 3, and a complicated bonding operation is required when the grids 2 are provided with a display device in which several kinds of display patterns are intricately incorporated. Furthermore, the phosphor layers deposited on the anodes are deteriorated by gas generated at the time of baking and crystallizing the adhesive material at the high temperature in order to fix the grids 2 to the substrate 3.

In view of the forgoing, it has been proposed and put into practical use to fix grids to a substrate as shown in FIG. 1 (B). In FIG. 1 (B), the grids 2 are fixed to spacer frames 4 having at least two leads 5 extending to the opposite directions at the upper and lower edges thereof, which are in turn held between a sealing portion of the substrate 6 and a front glass forming the outer envelope. This method is advantageous in that each of the grids 2 can be easily mounted at proper position of the substrate 6, and also the intermediate baking and crystallizing operation of the adhesive agent at the high temperature in order to fix the grids to the substrate which accompanies the generation of the hazardous gas can be entirely eliminated.

As a means for displaying various informations, there are a digital display system representing the informations in the form of numerals, an analog display system representing the informations in the form of graphs different in shape depending upon the magnitude of the input informations, and a graphic display system representing the informations in the form of figures. In the fluorescent display device, it is possible to effect the various types of the display as explained hereinabove, and the fluorescent display device can be formed in a composite structure capable of effecting the various types of the display, such as for example, both bar graphical and numerical displays, or time and program, in a single envelope. In order to effect the display of these complicated informations in the single envelope of the fluorescent display device, it is advantageous to divide the grid disposed between the anodes and cathodes into several pieces so as to electrically isolated each of the grids, and to actuate the fluorescent display device by a dynamic drive system.

However, when the composite fluorescent display device for effecting the display of the complicated multiple informations is constructed with the use of a plurality of the grids, the grids must be arranged in an extremely complicated manner. For example, in the method of mounting the grid by having the leads sandwitched at the sealing portion of the base substrate and the front glass as shown in FIG. 1 (B), it is impossible to provide the lead with at least some of the grids at their opposite ends thereof in view of the arrangement of the grids in the complicated manner within the tube. Thus, some of the grids are unstably held at their ends thereof in a cantilever fashion. When the unsealed ends of the grids are welded to the substrate by baking with the use of the adhesive material such as the crystalline powder glass as shown in FIG. 1 (A), it creates the same problems as explained hereinabove.

BRIEF SUMMARY OF THE INVENTION

Therefore, the present invention is intended to eliminate the above-mentioned disadvantages of the prior art.

It is an object of the present invention to provide a fluorescent display apparatus in which various types of the functional elements of the display device are incorporated in a complicated manner for effecting different types of display in a single evacuated envelope.

It is another object of the present invention to provide a fluorescent display apparatus for effecting different types of display in a single evacuated envelope which is reliable in operation, high in quality and applicable in various fields.

According to the present invention, the foregoing and other objects are attained by providing a fluorescent display apparatus in which a plurality of grids electrically isolated one after another and disposed in an opposed relationship at a close interval at the respective edges thereof are held on a substrate of the display device by having an elongated insulator placed along the opposed edges of the grids, thereby to secure the grids together in a simple, safe and reliable manner within an evacuated envelope of the display tube even though some of the grids are inevitable to be held in a cantilever fashion because of the structure of the display tube.

BRIEF DESCRIPTION OF DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENT

Now, a fluorescent display device according to the present invention will be hereinafter described with reference to the accompanying drawings.

Figure 1A:
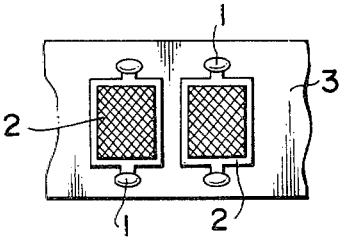
FIG. 1(A) (PRIOR ART)
FIGS. 1 (A) and 1 (B) respectively show plan views for illustrating methods of fixing grids to a substrate in the conventional fluorescent display device.
Figure 1B:
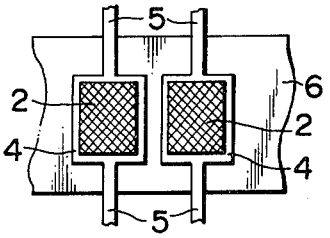
FIG. 1(B) (PRIOR ART)
Figure 2:
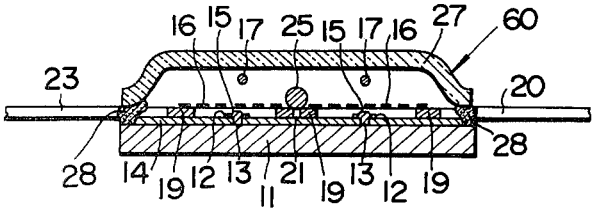
FIG. 2 shows a longitudinally sectional view of a fluorescent display device according to a first embodiment of the present invention.

FIG. 2 is a longitudinal sectional view of a fluorescent display device according to a first embodiment of the present invention. The fluorescent display device generally indicated by the reference numeral 60 includes a substrate 11 made of an insulating material, such as, for example, glass, ceramic or the like on which anodes 12, wiring films 13 for electrically connecting the anodes 12, an insulating film 14 for electrically insulating one anode from another and also the wiring films 14, and fluorescent layers 15 to be deposited on the upper surface of the anodes 12 are laminated in a superposed relationship. The anodes 12 are arranged in a predetermined pattern to form a pattern display section, and grids 16 and a filamentous cathode 17 are provided above the pattern display section.

Figure 3:
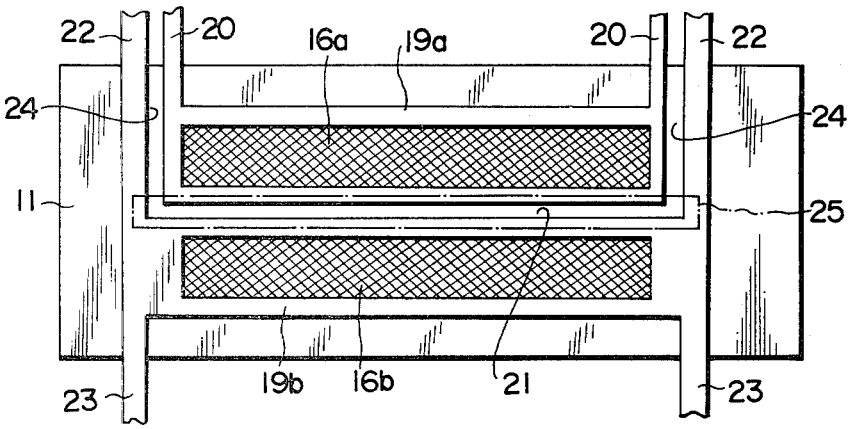
FIG. 3 is a plan view showing an example of a grid arrangement in the embodiment of FIG. 2.
Figure 4:
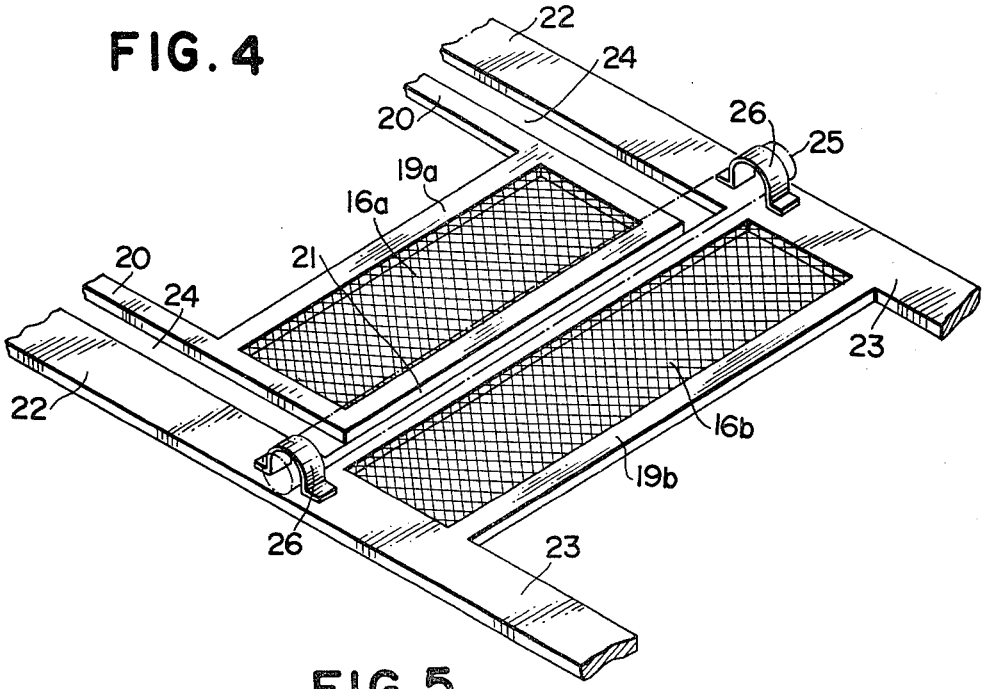
FIG. 4 is an enlarged perspective view of a grid arrangement shown in FIG. 3.

According to the embodiment of the present invention, the grid 16 is divided into two rows as shown in FIGS. 3 and 4. Each of the grids 16*a* and 16*b* is electrically independent and integrally mounted on spacer frames 19*a* and 19*b* respectively which are formed in the shape of a window frame. The spacer frame 19*a* includes leads 20 at both right and left sides thereof which extend upwardly to the exterior of the substrate 11. The spacer frame 19*b* is disposed to have a predetermined gap 21 between the spacer frames 19*a* and 19*b*, and is provided with leads 22 which extend upwardly to the exterior of the substrate 11 and leads 23 which extend downwardly to the exterior of the substrate 11 at both right and left sides thereof. The leads 22 extends outside the leads 20 which are provided with the spacer frame 19*a* maintaining a predetermined gaps 24 therebetween.

Reference numeral 25 designates a bar-shaped insulator having the diameter larger than the width of the gap 21 so that it may be placed over the gap 21 along the inner edges of the spacers 19*a* and 19*b*. In the embodiment shown in FIGS. 2–4, alumina ceramic which is formed in the shape of a round bar is used as the insulator. Both ends of the insulator 25 are fixed to the leads 22 of the spacer frame 19*b* by means of inverted U-shaped fittings 26. As shown in FIG. 2, the leads 20, 22 and 23 are sandwitched at the sealing portion of the substrate 11 and the front glass 27 around the outer periphery of the base plate 11, which is then welded by employing a sealing material 28 and hermetically sealing the same by heating the sealing material, thereby to form the evacuated envelope 60 formed of the substrate 11 and the front glass 27.

By the fixing of the leads 20, 22 and 23 to the outer peripheral edges of the base plate 11 as well as the fixing of the insulator 25 to the leads 22 at both ends thereof, the opposed edges of the spacer frames 19*a* and 19*b* are held by the base plate 11 and the insulator 25.

In the first embodiment explained hereinabove, the rod shape ceramic is used as the insulator 25. However, it may be glass, mica or the like, and may be of any shape, such as, for example, triangular, rectangular, polygonal or the like, without limiting its shape to circular as shown in the drawings.

According to the fluorescent display device explained hereinabove, the electrically separated grids 16*a* and 16*b* are held by the insulator 25 which extends along the opposed edges of the grids 16*a* and 16*b* to press the same against the substrate 11. Thus, the grid 16*a* held by the leads 20 in a cantilever fashion is locked by the insulator 25 so as to prevent the grid 16*a* from lifting from the substrate 11. In addition, the insulator 25 is effective to prevent a deformation of the grid 16*b*. According to the embodiment, the opposed edges of the grids 16*a* and 16*b* are held by the locking action of the insulator 25, therefore, the distortion of the grids 16*a* and 16*b* due to the thermal expansion or the like is absorbed in the gap 21, thereby to prevent the deformation of the grids 16*a* and 16*b* resulting from the internal distortion of the grids.

Reference will now be made to grid arrangements according to second, third, fourth embodiments of the present invention shown in FIGS. 5, 6 and 7, respectively. It should be understood that the second, third, fourth embodiments are equivalent to the first embodiment except for the grid and lead arrangements. Therefore, the explanation of the elements equivalent or similar to the first embodiment will be omitted, and the same or similar parts are designated by like reference characters throughout the figures thereof.

Figure 5:
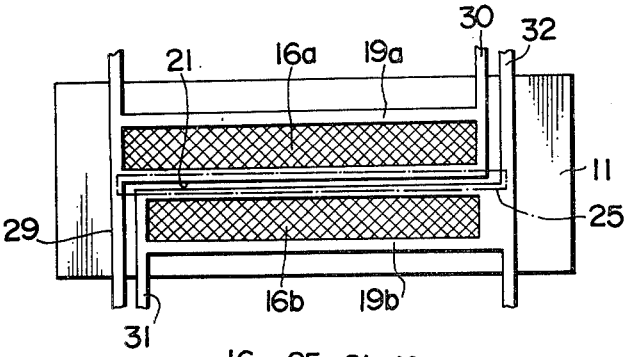
FIG. 5 is a plan view showing another example of a grid arrangement according to a second embodiment of the present invention.

A grid shown in FIG. 5 is divided into two rows, namely upper and lower rows similar to the first embodiment. Each of the grids 16*a* and 16*b* is integrally mounted on the upper and lower spacer frames 19*a* and 19*b*. The upper spacer frame 19*a* includes a lead 29 provided at the left side thereof which extends vertically to the exterior of a substrate 11 in both upper and lower directions, and a lead 30 at the right side thereof which extends vertically to the exterior of the substrate in the upper direction. Similarly, the lower spacer frame 19*b* includes a lead 31 which extends downwardly to the exterior of the substrate 11 in parallel with and inside the lead 29, and a lead 32 which extends to the exterior of the substrate 11 in both upper and lower directions in parallel with and outside the lead 30. In the second embodiment, the spacer frames 19*a* and 19*b* are held in a cantilever fashion, however, these frames 19*a* and 19*b* are firmly clamped by the insulator 25 and the lifting and the deformation of the grids 16*a* and 16*b* can be prevented. The grid arrangements in the first and second embodiments are primarily used for a level meter in audio equipment.

Figure 6:
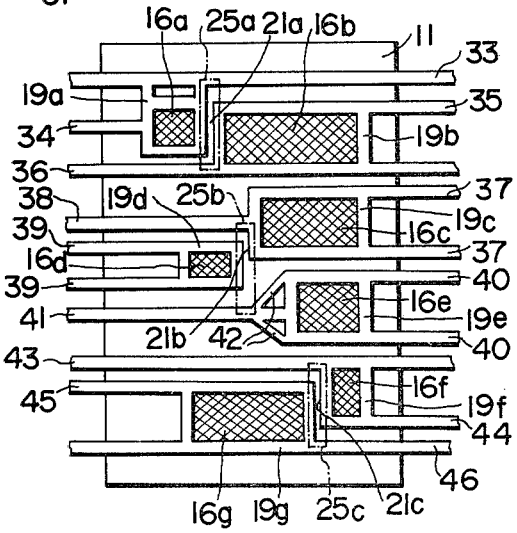
FIG. 6 is a plan view showing another example of a grid arrangement according to a third embodiment of the present invention.
Figure 7:
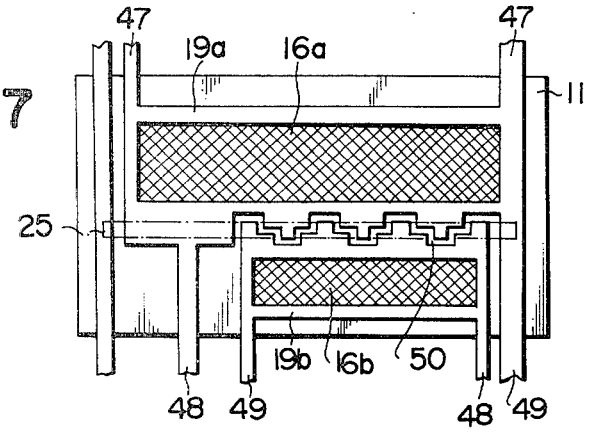
FIG. 7 is a plan view showing another example of a grid arrangement according to a fourth embodiment of the present invention.

Referring now to the third embodiment shown in FIG. 6, a grid shown in FIG. 7 is divided into seven portions, namely grids 16*a*–16*g*. Each of the grids is integrally mounted on respective spacer frames 19*a* to 19*g*. The spacer frame 19*a* includes a lead 33 extending to the exterior of a substrate 11 in the right and left directions and a lead 34 extending to the exterior of the substrate 11 in the left direction. On the right side of the spacer frame 19*a*, a spacer frame 19*b* is disposed in close proximity of the spacer frame 19*a*. The spacer frame 19*b* includes a lead 35 extending to the exterior of the substrate 11 in the right direction and a lead 36 extending to the exterior of the substrate 11 in the right and left directions below the spacer frame 19*a*. In the same manner, the spacer frame 19*c* is disposed below the spacer frame 19*b*, which includes two leads 37 extending to the exterior of the substrate 11 in the right direction and a lead 38 extending from the center of the left side of the spacer frame 19*c* to the exterior of the substrate 11. The spacer frame 19*d* is located at the position which is adjacent to the spacer frame 19*c* under the lead 38, and includes two leads 38 and 39 extending to the exterior of the substrate in the left direction. The spacer frame 19*e* is disposed below the spacer frame 19*c* in its close proximity, and includes two leads 40 extending to the exterior of the substrate 11 in the right direction and a lead 41 extending from the center of the left side of the spacer frame 19*e* to the exterior of the substrate 11 in the left direction. The lead 41 is provided with axiliary leads 42 extending from the upper and lower left ends of the spacer frame 19*e* to the lead 41. The spacer frame 19*f* is disposed below the spacer frame 19*e*, and includes a lead 43 extending to the exterior of the substrate 11 in the right and left directions and a lead 44 extending to the exterior of the substrate in the left direction. On the left side of the spacer frame 19*f*, the spacer frame 19*g* is disposed in close proximity of the spacer frame 19*f*. The spacer frame 19*g* includes a lead 45 extending to the exterior of the substrate 11 in the right direction and a lead 46 extending to the exterior of the substrate 11 in the right and left directions below the spacer 19*f*.

The grids are arranged in such manner as explained hereinabove, and gaps 21*a*, 21*b* and 21*c* are formed between the spacer frames 19*a* and 19*b*, 19*d* and 19*c* and 19*g* and 19*f*, respectively. Rod-shaped insulators 25*a*, 25*b* and 25*c* are mounted on the respective gaps 21*a*, 21*b* and 21*c* to hold the edges of each of the spacer frames which are supported in a cantilever fashion so as to prevent the lifting of the grid 16.

In the grid arrangement in the third embodiment explained hereinabove, figure and numeral indicating portions are formed within the areas of the grids 16*a*, 16*d*, and 16*g*, and bar graph indicating portions are formed within the areas of the grids 16*b*, 16*c*, 16*e*, and 16*f*. This arrangement of the grid is useful for a fuel level meter on a vehicle.

Referring now to the fourth embodiment of the present invention shown in FIG. 7, the fluorescent display device shown in FIG. 7 includes a larger grid 16*a* and a smaller grid 16*b* which are separated and disposed at the upper and lower portions of a substrate 11. The larger grid 16*a* is fixed to a spacer frame 19*a* which includes leads 47 and 48 provided at the right and left corners of the spacer frame 19*a* and extended upwardly and downwardly to the exterior of the substrate 11. Between the downwardly extending leads 48, there is provided the smaller grid 16*b*. The smaller grid 16*b* is fixed to a spacer frame 19*b* which includes leads 49 extending downwardly to exterior of a substrate 11. The opposed edges of the spacer frames 19*a* and 19*b* are of continuous concave and convex structure and define a gap 50 therebetween. An insulator 25 is mounted along the center line of the gap 50 to hold the spacer frames 19*a* and 19*b* so as to prevent the deformation of the grid 16*a* and the lifting of the grid 16*b*. The arrangement of the grid in the fourth embodiment explained hereinabove is useful for a composite clock which displays time and program in one device.

Reference will now be made to the fifth and sixth embodiments of the present invention shown in FIGS. 8, 9 and 10. It should be understood that the fifth and sixth embodiments are equivalent to the first embodiment except for the grid and the arrangement of the insulator. Therefore, the explanation of the elements equivalent or similar to the first embodiment will be omitted, and the same or similar parts are designated by like reference characters throughout the figures thereof.

Figure 8:
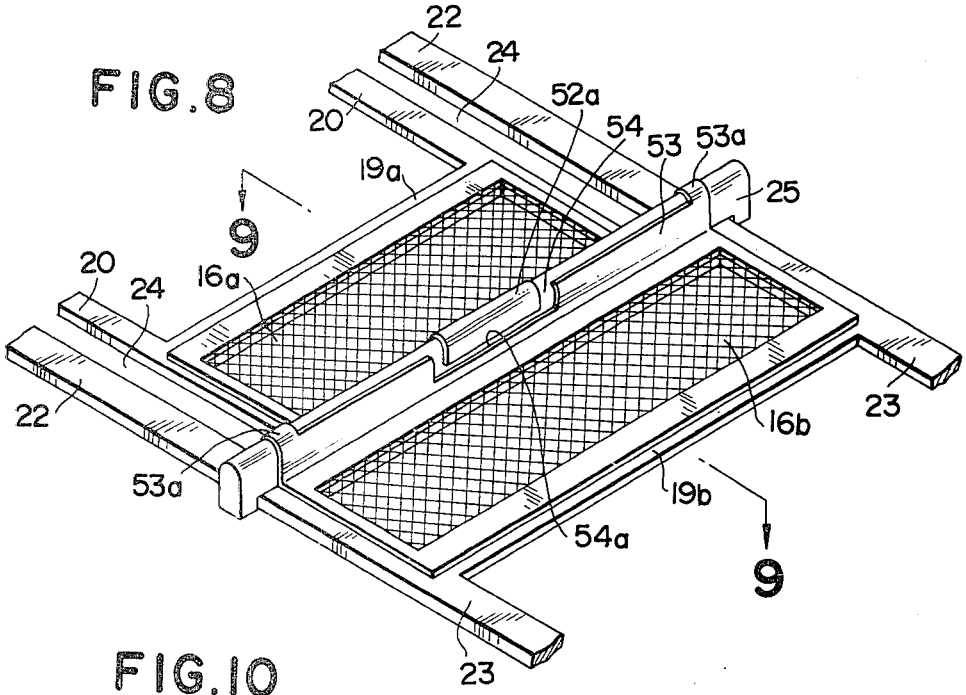
FIG. 8 is a perspective view showing another example of a grid arrangement according to a fifth embodiment of the present invention.
Figure 9:
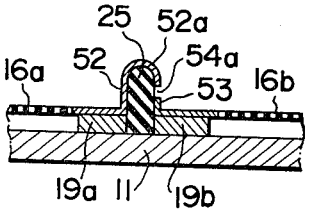
FIG. 9 is a sectional view taken along the line 9—9 of FIG. 8.

An insulator 25 according to the fifth embodiment shown in FIG. 8 is made of mica which is substantially rectangular in cross section. As shown in FIG. 9 which is a sectional view taken along the line 9—9 of FIG. 8, the insulator 25 is disposed between spacer frames 19*a* and 19*b*. Grids 16*a* and 16*b* are fixed to the respective spacer frames 19*a* and 19*b*, and the spacer frames 19*a* and 19*b* are bent upwardly at the longitudinal side edges adjoining the insulator 25 to form vertical walls 52 and 53 which project along the contour of the insulator 25. At the center portion of the wall 52 of the spacer frame 19*a*, a hook 52*a* for catching the insulator 25 is formed. In this manner, the insulator 25 is held by the vertical wall 52 and catched by the hook 52*a*. The vertical wall 53 of the spacer frame 19*b* includes a notch at the position corresponding to the hook 52*a* of the vertical wall 53. By the provision of the notch 54, a gap 54*a* having a predetermined width is formed between the vertical wall 53 and the hook 52*a*. The vertical wall 53 is provided with hooks 53*a* for catching the insulator 25 at the right and left ends thereof. In this manner, the grids 16*a* and 16*b* are secured together by means of the insulator 25, thereby to prevent the spacer 19*a* having leads 20 on one side from lifting upwardly within the evacuated envelope of the display tube.

Figure 10:
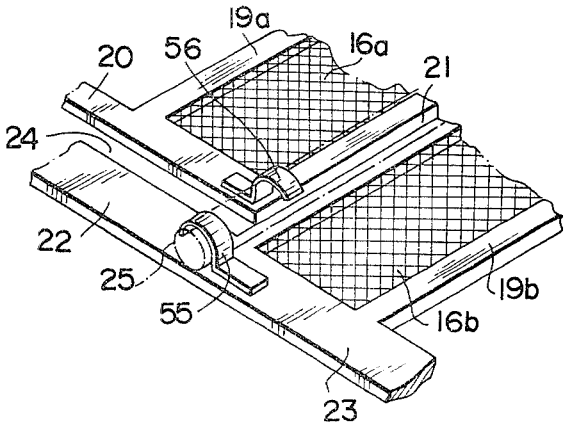
FIG. 10 is a perspective view showing another example of a grid arrangement according to a sixth embodiment of the present invention.

Referring now to the sixth embodiment shown in FIG. 10, an insulator 25 shown in FIG. 10 is fixed to a lead 22 by a hook-shaped fitting 55 at the ends thereof, and also by a hook-shaped fitting 56 mounted on a spacer frame 19*a* at the inner portions thereof. Thus, grids 16*a* and 16*b* are secured together by means of the insulator 25, thereby to prevent the lifting of the spacer 19*a*.

As stated hereinabove, the fluorescent display device according to the present invention comprises a plurality of the grids which are electrically separated and disposed in close proximity and in an opposed relationship at the respective edges thereof, and an insulator mounted on the grids along the respective opposed edges thereof so that the grids may be connected together. Thus, according to the present invention, it is possible for the grids which are inherently inevitable to be supported in a cantilever fashion within the tube to firmly and reliably to secure the appropriate positions of the display device. Furthermore, according to the present invention, the exact locations on which the grids are mounted can be rapidly determined, because there is no trouble to lift the unsealed portions of the grids.

In addition, the fluorescent display device according to the present invention, it is not necessary to conduct a welding operation of the grids on the substrate using powdered glass or the like within the display device, which requires the intermediate heating and baking processes. Therefore, the working efficiency for producing the display device is remarkably improved.

Also, it is possible to easily and correctly determine the locations on which the grids are mounted.

Obviously, many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A fluorescent display device comprising:

a vacuum casing made up of a substrate and a front cover airtightly bonded together;

a pattern display section composed of a plurality of anodes each coated with a phosphor layer on the upper surfaces thereof and disposed on said substrate;

a plurality of control electrodes electrically isolated one after another and mounted above said pattern display section, said control electrodes being secured to spacer frames and at least some of said control electrodes being arranged in an opposite relationship making edges of said spacer frames adjacent;

a filamentary cathode stretched above said control electrodes for emitting thermions to be selectively impinged on said anodes to effect luminous display of letters or figures; and an elongated insulator mounted on at least two adjacent control electrodes along the opposed edges of said spacer frames, whereby each of the control electrodes is connected together at the opposed edges of said spacer frames by means of said insulator.

2. The fluorescent display device as defined in claim 1, wherein said elongated insulator is secured to either one of said adjoining spacer frames.

3. The fluorescent display device as defined in claim 1, wherein at least one of said spacer frames includes hook for catching said insulator.

* * * * *